United States Patent [19]

Yamaguchi et al.

[11] 4,409,084

[45] Oct. 11, 1983

[54] ELECTROLYTIC CELL FOR ION EXCHANGE MEMBRANE METHOD

[75] Inventors: Kenzo Yamaguchi, Tokyo; Teruo Ichisaka; Tadao Ikegami, both of Tamano, all of Japan

[73] Assignee: Chlorine Engineers Corp. Ltd., Tokyo, Japan

[21] Appl. No.: 292,464

[22] Filed: Aug. 13, 1981

[30] Foreign Application Priority Data

Aug. 22, 1980 [JP] Japan ..... 55/114822

[51] Int. Cl.[3] ..... C25B 9/00; C25B 11/03; C25B 13/02; C25B 13/08

[52] U.S. Cl. ..... 204/257; 204/263; 204/279; 204/283; 204/296

[58] Field of Search ..... 204/283, 252–258, 204/263–266, 279, 282, 296

[56] References Cited

U.S. PATENT DOCUMENTS

| | | | |
|---|---|---|---|
| 4,017,376 | 4/1977 | Mose et al. | 204/283 X |
| 4,118,306 | 10/1978 | De Nora et al. | 204/283 X |
| 4,152,225 | 5/1979 | Woodard, Jr. et al. | 204/283 X |
| 4,229,277 | 10/1980 | Specht | 204/282 X |
| 4,278,523 | 7/1981 | Byrd et al. | 204/283 X |
| 4,283,264 | 8/1981 | Darling et al. | 204/282 X |

*Primary Examiner*—Donald R. Valentine
*Attorney, Agent, or Firm*—Sughrue, Mion, Zinn, Macpeak and Seas

[57] ABSTRACT

An electrolytic cell for the ion exchange membrane method, which comprises:

(a) an electrolytic cell main body;
(b) a lid covering the
(c) porous and hollow tubular cathodes disposed in the body;
(d) a bottom plate having apertures through which an electrically conductive bar can be extended;
(e) electrically conductive bars provided with a flange at a lower portion thereof, each inserted through the apertures of the bottom plate into the interior of the body and secured to the bottom plate by the flange;
(f) porous anodes each connected to the electrically conductive bar and placed vertically in a face-face relation to the cathode, and disposed between the cathodes;
(g) bag-shaped elements, portions of which facing the anodes and the cathodes are formed by a cation exchange membrane, the bottom of which has at least one aperture through which the electrically conductive bar can be extended, and which have each an open top; and
(h) a partition plate having openings, which plate is on the top of the body, wherein one or more anodes are in the bag-shaped element, the bottom of the bag-shaped element is secured to the bottom plate together with the electrically conductive bar extending through the aperture of the bottom of the bag-shaped element by the flange of the electrically conductive bar so that an anode compartment is defined in the bag-shaped element, and the opening of the top of the bag-shaped element is secured to the opening of the partition plate by a gasket and a gasket cap.

7 Claims, 6 Drawing Figures

ELECTROLYTIC CELL FOR ION EXCHANGE MEMBRANE METHOD

FIELD OF THE INVENTION

This invention relates to an electrolytic cell for an ion exchange membrane method, which is particularly suitable for obtaining halogen and alkali metal hydroxide by electrolyzing an aqueous solution of alkali metal halide, particularly sodium chloride.

BACKGROUND OF THE INVENTION

Heretofore, in electrolysis of brine, a diaphragm method in which an anode compartment and a cathode compartment are defined by a porous neutral diaphragm comprising asbestos or the like has been employed in place of the mercury method. This diaphragm method, however, has the disadvantage that it cannot be used to produce high quality alkali metal hydroxides. Thus, for electrolysis of brine to obtain high quality alkali metal hydroxides, a so-called ion exchange membrane method using a cationic exchange membrane has been developed.

SUMMARY OF THE INVENTION

An object of this invention is to provide an electrolytic cell suitable for use in the ion exchange membrane method, which is obtained by modifying an electrolytic cell heretofore used in the diaphragm method, and thus provide an electrolytic cell which can be assembled by utilizing equipment used in the electrolytic cell for the diaphragm method. Furthermore, the electrolytic cell of this invention has advantages in that when it is used in the ion exchange membrane method, there is no danger of liquid leakage and the cell voltage can be maintained at a low level.

This invention, therefore, provides an electrolytic cell for the ion exchange membrane method, which comprises:

(a) an electrolytic cell main body;

(b) a lid member completely covering the electrolytic cell main body;

(c) a plurality of porous and hollow tubular cathodes disposed in the electrolytic cell main body;

(d) an electrolytic cell bottom plate having therein a plurality of apertures through which an electrically conductive bar can be extended;

(e) a plurality of electrically conductive bars provided with a flange at a lower portion thereof, which are each inserted through the aperture of the electrolytic cell bottom plate into the interior of the electrolytic cell main body and secured to the electrolytic cell bottom plate by the flange;

(f) a plurality of porous anodes which are each connected to the electrically conductive bar and placed vertically in a face-face relation to the cathode, and which are disposed between the cathodes;

(g) a plurality of bag-shaped elements, at least the portions of which facing the anodes and the cathodes are formed by a cation exchange membrane, the bottom of which is provided with at least one aperture through which the electrically conductive bar can be extended, and each of which has an open top; and (h) a partition plate having therein a plurality of openings, which is provided on the top of the electrolytic cell main body, wherein one or more anodes are in the bag-shaped element, the bottom of the bag-shaped element is secured to the electrolytic cell bottom plate together with the electrically conductive bar extending through the aperture of the bottom of the bag-shaped element by the flange of the electrically conductive bar so that an anode compartment is defined in the bag-shaped element, and the opening of the top of the bag-shaped element is secured to the opening of the partition plate by a gasket and a gasket cap.

The bag-shaped element which can be used in the present invention may be one such that the entire molded article is formed by a cation exchange membrane, or only the portion facing the anodes or cathodes is formed by a cation exchange membrane, the frame portion of the bag-shaped element is formed by an anti-corrosive material such as Teflon, and the cation exchange membrane is sealed to the frame portion. Further, the bag-shaped element may be formed along the anodes therein and the electrically conductive bar inserted through the aperture of the electrolytic cell bottom plate.

DETAILED DESCRIPTION OF THE INVENTION

Figure 2:
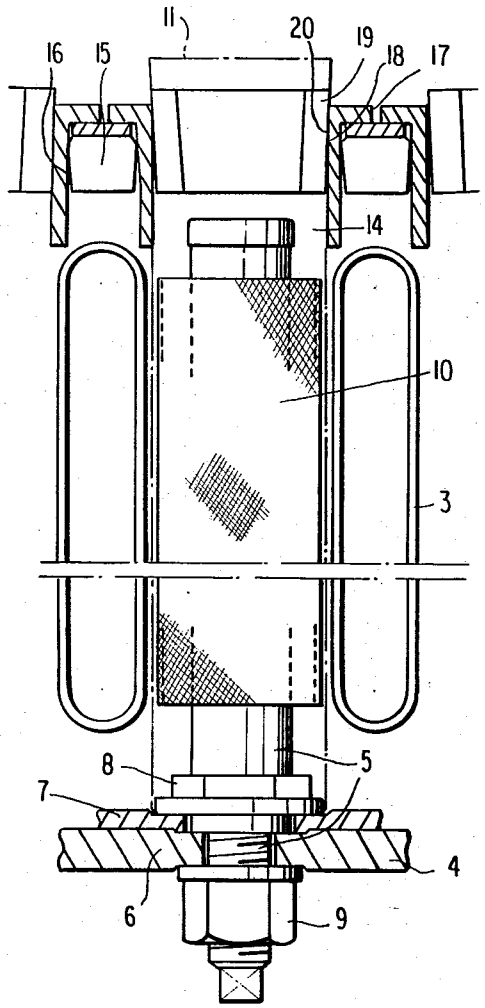
FIG. 2 is a partially enlarged longitudinal-sectional view of an embodiment of the electrolytic cell according to this invention.
Figure 1:
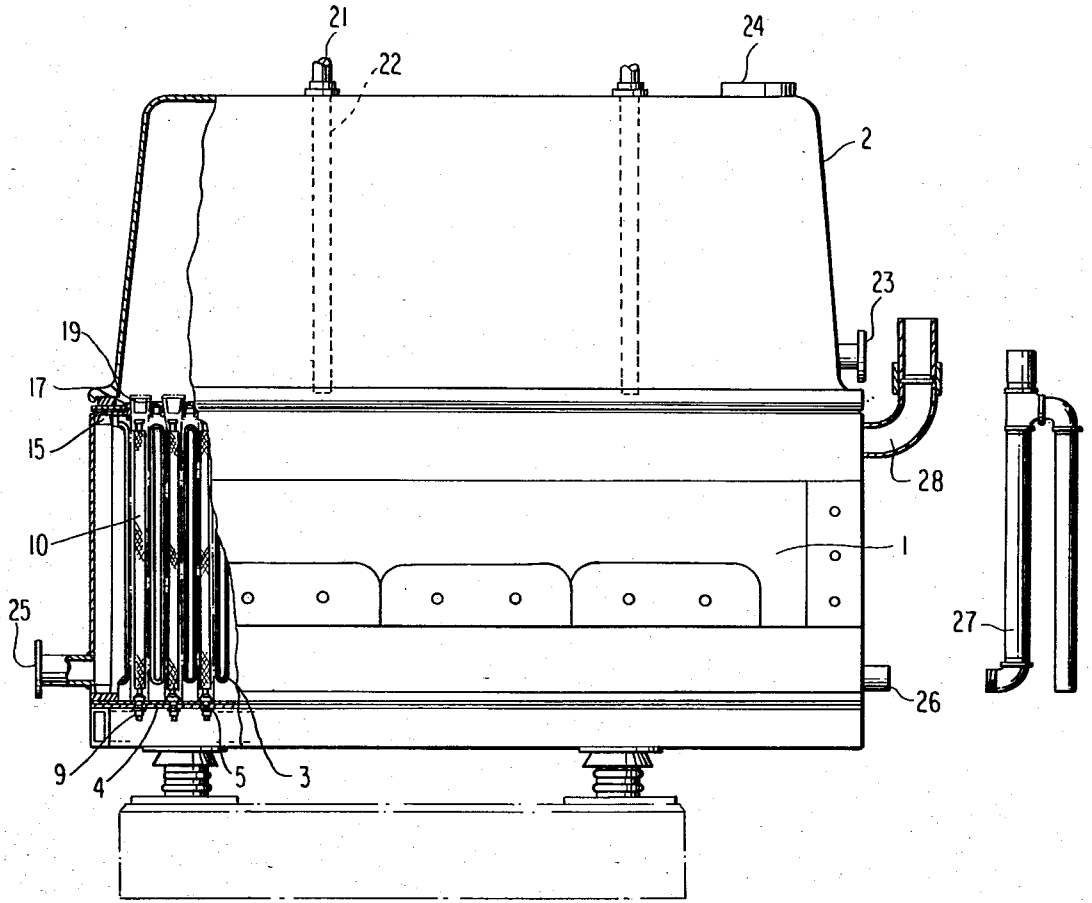
FIG. 1 is a fragmental, longitudinal-sectional view of an embodiment of the electrolytic cell according to this invention.
Figure 3:
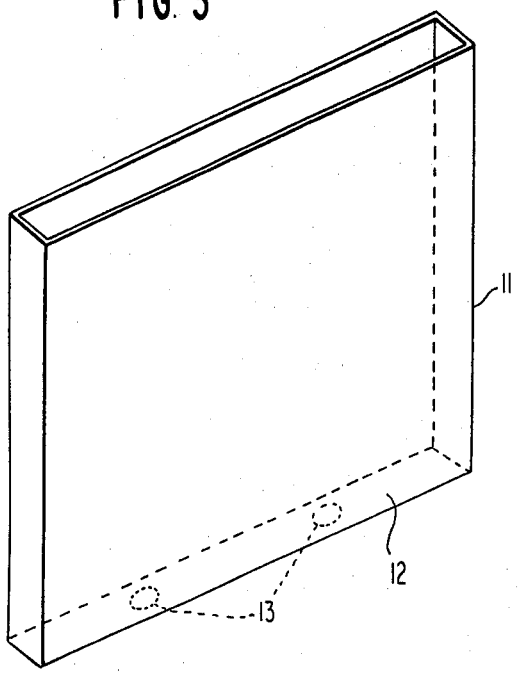
FIG. 3 is a perspective view of a bag-shaped element for use in this invention, which is entirely formed by a cation exchange membrane.

Hereinafter, this invention is described in greater detail with reference to the accompanying drawings wherein FIGS. 1 and 2 are, respectively, a fragmentally longitudinal-sectional side view and a partially enlarged longitudinal-sectional view of an embodiment of the cell according to this invention; and FIG. 3 is a perspective view of a cation exchange membrane for use in this invention.

A lid member 2 completely covers electrolytic cell main body 1. In the electrolytic cell main body 1, a plurality of porous and hollow tubular cathodes 3 are disposed so that they extend from one inner side wall to the opposite inner side wall of the electrolytic cell main body 1. An electrolytic cell bottom plate 4 has a plurality of apertures 6, each of which is positioned at a location just intermediate between two adjacent cathodes 3, and through which an electrically conductive bar 5 can be extended. The inner surface of the electrolytic cell bottom plate 4 is provided with an anti-corrosive lining 7 made of rubber, a fluorine resin, or the like. The electrically conductive bar is provided with a flange at a lower portion thereof, and it extends through the aperture 6 of the electrolytic cell bottom plate 4 into the interior of the electrolytic cell main body 1 and is secured to the electrolytic cell bottom plate 4 with the flange 8 by fastening a nut 9. An anode 10 is connected to the electrically conductive bar 5, vertically supported in a face-face relation to the cathode 3, and is disposed at a location intermediate and between two adjacent cathodes 3.

Suitable materials which can be used for the anodes used in this invention include valve metals (e.g., titanium, tantalum, niobium, etc.) having a coating layer thereon containing platinum group metal oxide and suitable materials for the cathodes include mild steel, stainless steel, nickel, nickel coated steel, etc.

An element 11 is designed in a rectangular bag-shaped form so that it can accommodate therein one or more anodes 10, and its top is open. The bag-shaped element 11 is provided at the bottom 12 thereof at a location corresponding to the aperture 6 of the electrolytic cell bottom plate 4 with an aperture 13 through which the electrically conductive bar can be extended. The bag-shaped element 11 accommodates therein one or more anodes 10 in close relation to each other, and it is secured to the electrolytic cell bottom plate 4 together with the electrically conductive bar 5 extending through the aperture 13 of the bag-shaped element bottom plate 12 by the flange 8 at the flange portion. Thus, an anode compartment 14 is defined in the bag-shaped element 11. In bringing the element 11 in close contact with the anode 10, it is preferred to use an anode having a cylindrical structure wherein the anode surface can be extended in the cathode direction.

A partition plate 15 having therein a plurality of openings 16 is provided on the top of the electrolytic cell main body 1 in such a manner that each opening 16 is disposed above each anode compartment 14.

Suitable materials for the electrolytic cell main body, the lid member, the bottom plate and the partition plate can be easily selected and an exemplary material for these elements is steel. Electrically conductive materials for, e.g., bar 5, can be any material which is electrically conductive and suitable for use. For example, copper coated with a valve metal such as titanium is suitable.

A gasket 17 having a plane surface 18 is provided to the whole periphery of the opening 16 of the partition plate 15. A gasket cap 19 has a plane surface 20 engaging the plane surface 18 of the gasket 17 and is open in the central portion thereof. Between the plane surface 18 of the gasket 17 and the plane surface 20 of the gasket cap 19, the upper open edge of the bag-shaped element 11 is held and secured. In order to firmly hold the element 11 and to prevent liquid leakage, it is desirable to employ a gasket made of an elastic material, such as rubber, and a gasket cap made of a hard material, such as Teflon. It is preferred that the plane surface 18 of the gasket 17 and the plane surface 20 of the gasket cap 19 are slanted so as to tightly engage the gasket 17 and the gasket cap 19.

If necessary, a spacer is interposed between the element 11 and the cathode 3. The width of the space maintained by the interposition of the spacer is desirably from about 1 to 5 mm, preferably from about 2 to 3 mm, in order to facilitate the rising of gas at the cathode side and to maintain the cell voltage at a moderate level.

Brine is introduced into the electrolytic cell through a brine intake 21. A brine outlet 23 is provided at the side portion of the lid member 2 so that the level of the brine is controlled above the partition plate 15, gasket 17 and gasket cap 19. The lower end of brine conduit 22 is positioned at a location intermediate the brine outlet 23 and the partition plate 15 so that it is below the level of the brine in the electrolytic cell. An outlet 24 through which the anode produced gas (in the electrolysis of brine, chlorine gas) filled inside the lid member 2 is withdrawn is provided in the lid member 2 at an upper portion thereof. The reference numeral 25 indicates an inlet through which a cathode liquid (in electrolysis of brine, water or a dilute aqueous solution of sodium hydroxide) is introduced, and it is designed so that the cathode liquid introduced is supplied to all cathode compartments which are defined by the bag-shaped element 11. An outlet 26 through which the cathode liquid subjected to electrolysis (in electrolysis of brine, a concentrated aqueous solution of sodium hydroxide) is withdrawn is connected to a conduit 27 to maintain the level of the cathode liquid. A cathode produced gas outlet 28 is provided in the electrolytic cell main body at an upper portion of the side wall thereof so that the cathode produced gas (in electrolysis of brine, hydrogen gas) can be withdrawn from the upper portion of the cathode compartment.

In addition to the foregoing technique to supply the brine, another technique can be employed in which a manifold is provided at the end of a brine conduit through which the brine introduced from the brine intake 21 passes, thin tubes from the manifold are extended into the corresponding anode compartments, and thus the brine introduced is fed to each anode compartment.

Figure 4:
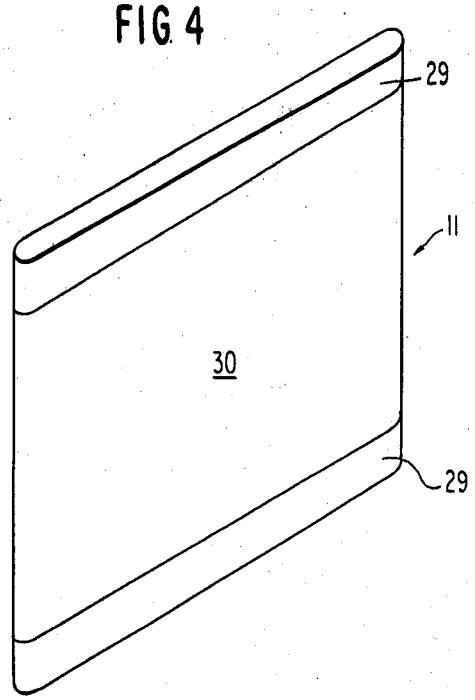
FIGS. 4 to 6 are each a perspective view of various embodiments of the bag-shaped element according to this invention.
Figure 5:
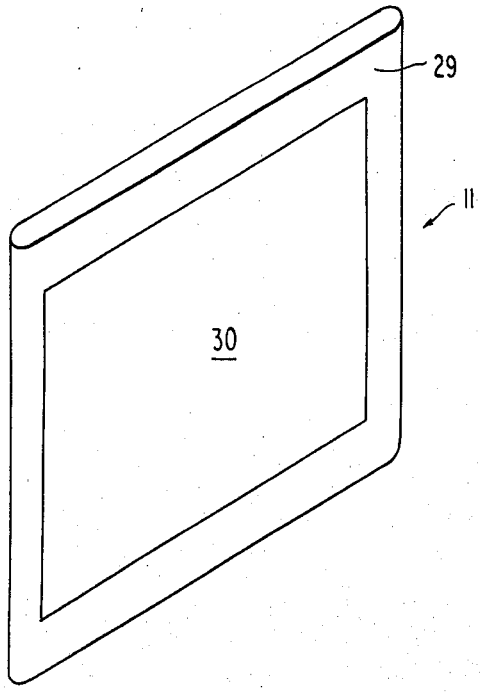
Figure 6:
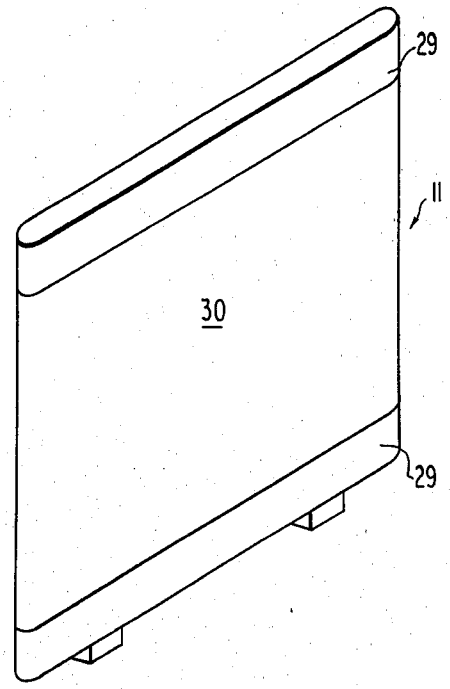

Various embodiments of bag-shaped element 11 can be used as shown in FIG. 3 wherein the molded article is formed by a cation exchange membrane or as shown in FIGS. 4 to 6. Suitable materials for the cation exchange membrane include fluorine-containing cation exchange membranes having copolymer structure comprising a fluorinated olefin monomer and fluorovinyl monomer having carboxylic acid groups, sulfonic acid groups or functional groups which are convertible to such acid groups.

FIG. 4 shows an embodiment in which the lower portion of the element fixed on the electrolytic cell bottom plate and the upper portion of the element held by the gasket and the gasket cap are formed of an anti-corrosive material such as fluorocarbon resins (e.g., Teflon), and the central portion facing the anodes and cathodes is formed of the cation exchange membrane 30.

FIGS. 5 and 6 show an embodiment that only the portions facing the anodes and the cathodes are formed by the cation exchange membrane, and the frame portions are formed by an anti-corrosive material 29. In FIG. 6, the lower portion of the element has a shape along the electrically conductive bar inserted through the aperture of the electrolytic cell bottom plate.

The bag-shaped element used in the present invention is not limited to only the above-described embodiments, and it is only necessary in the present invention that at least the portions facing the anodes and the cathodes are formed by the cation exchange membrane. Other portions are formed by anti-corrosive material and their structure can be varied depending upon the electrode structure.

Where the bag-shaped element is formed by the cation exchange membrane and the anti-corrosive material, the cation exchange membrane and the anti-corrosive material are joined by, for example, heat-sealing.

As described above, where the upper portion and the lower portion of the bag-shaped element are formed by the anti-corrosive material, if the portions contacting the corners of the cylindrical anodes are formed by the anti-corrosive material, the cation exchange membrane, which tends to damage, can be protected.

The electrolytic cell of this invention has a structure that is suitable for converting an electrolytic cell heretofore used in the diaphragm method into an electrolytic cell for the ion exchange membrane method. In the usual electrolytic cell for use in the diaphragm method in which a neutral diaphragm comprising asbestos is used, a porous and hollow tubular cathode is covered with the asbestos diaphragm by a deposition method, etc., to thereby define a cathode compartment, and an anode supported on an electrically conductive bar is disposed between cathodes covered with the diaphragm. Thus, parts of the electrolytic cell for the diaphragm method, such as the electrolytic cell main body, the lid member, cathodes and anodes, can be utilized to assemble the electrolytic cell of this invention.

In accordance with this invention, the cation exchange membrane is in a bag-shaped form; the bottom of the cation exchange membrane is secured to the electrolytic cell bottom plate by the flange; and the upper open edge of the bag-shaped element is secured to the opening of the partition plate, which is provided on the top of the electrolytic cell main body, by the gasket and the gasket cap. Therefore, the cation exchange membrane can be fixed firmly and without the danger of liquid leakage, and at the same time, since the cation exchange membrane and the anode can be brought in close contact with each other, the cell voltage can be stabilized and furthermore can be maintained at a low level. Thus, the structure of the present electrolytic cell per se is excellent as an electrolytic cell for the cation exchange membrane method.

Furthermore, by appropriately providing the spacer between the cathode and the cation exchange membrane, the space between electrodes, or between the cathode and the ion exchange membrane can be held, if necessary.

Additionally, by holding the upper open edge of the bag-shaped element between the slant surfaces of the gasket and the gasket cap, which engage each other, the cation exchange membrane can be easily secured. It is effective to use an elastic material, such as rubber, for the production of the gasket, and to use a hard material for the production of the gasket cap. This permits the cation exchange membrane to be fixed more firmly.

Electrolysis of alkali metal halide solutions using the electrolytic cell of this invention can be conducted easily, for example, using conventional processing conditions such as a cell voltage of about 2.8 to 3.7 volts, a current density of about 20 to 30 amperes per $dm^2$ and a temperature of about 50° to 90°.

While the invention has been described in detail and with reference to specific embodiments thereof, it will be apparent to one skilled in the art that various changes and modifications can be made therein without departing from the spirit and scope thereof.

What is claimed is:

1. An electrolytic cell for the ion exchange membrane method, which comprises:

(a) an electrolytic cell main body;

(b) a lid member completely covering the electrolytic cell main body;

(c) a plurality of porous and hollow tubular cathodes disposed in the electrolytic cell main body;

(d) an electrolytic cell bottom plate having therein a plurality of apertures through which an electrically conductive bar can be extended;

(e) a plurality of electrically conductive bars provided with a flange at a lower portion thereof, which are each inserted through the apertures of the electrolytic cell bottom plate into the interior of the electrolytic cell main body and secured to the electrolytic cell bottom plate by the flange;

(f) a plurality of porous anodes which are each connected to the electrically conductive bar and placed vertically in a face-face relation to the cathode, and which are disposed between the cathodes;

(g) a plurality of bag-shaped elements, at least the portions of which facing the anodes and the cathodes are formed by a cation exchange membrane, the bottom of which is provided with at least one aperture through which the electrically conductive bar can be extended, and which have each an open top; and (h) a partition plate having therein a plurality of openings, which plate is provided on the top of the electrolytic cell main body, wherein one or more anodes are in the bag-shaped element, the bottom of the bag-shaped element is secured to the electrolytic cell bottom plate together with the electrically conductive bar extending through the aperture of the bottom of the bag-shaped element by the flange of the electrically conductive bar so that an anode compartment is defined in the bag-shaped element, and the opening of the top of the bag-shaped element is secured to the opening of the partition plate by a gasket and a gasket cap.

2. An electrolytic cell as in claim 1, wherein the bag-shaped element is secured by holding the complete periphery of the upper open edge of the bag-shaped element between the gasket and the gasket cap, said gasket having a slanted surface capable of being attached onto the periphery of the opening of the partition plate, said gasket cap having slanted surface engaging with the slanted surface of the gasket and being open in the central portion thereof, and the periphery of the upper open edge of the bag-shaped element being held between these slanted surfaces engaging with each other.

3. An electrolytic cell as in claim 1, wherein a spacer is provided between the bag-shaped element and the cathode in order to produce a space therebetween and the bag-shaped element is in close contact with the anode.

4. An electrolytic cell as in claim 1 or 2, wherein the gasket is made of an elastic material, and the gasket cap is made of a hard material.

5. An electrolytic cell as in claim 1 or 2, wherein a brine outlet is provided above the partition plate, and the top of a brine conduit is positioned at a location intermediate and between the partition plate and the brine outlet.

6. An electrolytic cell as in claim 1 or 2, wherein a manifold is provided to the top of the brine conduit, and thin tubes from the manifold extended into the interior of each anode compartment.

7. An electrolytic cell as in claim 1 or 3, wherein the anode is a cylindrical anode having an anode action surface capable of being extended toward the cathode.

* * * * *